United States Patent [19]

Stock

[11] 4,138,040

[45] Feb. 6, 1979

[54] DISPENSER FOR ANAEROBIC AND CYANOACRYLATE ADHESIVES

[75] Inventor: Hugh J. Stock, Saratoga, Calif.

[73] Assignee: Pacer Industries, Inc., Campbell, Calif.

[21] Appl. No.: 676,229

[22] Filed: Apr. 12, 1976

[51] Int. Cl.[2] ..... B65D 47/18

[52] U.S. Cl. ..... 222/420; 222/527; 222/569

[58] Field of Search ..... 222/420, 569, 527, 421, 222/422, 567, 570; 401/265; 138/DIG. 3, 118; 73/425.4 P

[56] References Cited

U.S. PATENT DOCUMENTS

| | | | |
|---|---|---|---|
| 1,970,688 | 8/1934 | Callahan | 222/420 |
| 2,673,661 | 3/1954 | Barton | 222/569 X |
| 2,789,734 | 4/1957 | Biederman | 222/420 X |
| 2,846,126 | 8/1958 | Warren | 222/570 |
| 2,974,528 | 3/1961 | Sanz | 73/425.4 P |
| 3,134,515 | 5/1964 | Callahan | 222/527 X |
| 3,915,651 | 10/1975 | Nishi | 73/425.4 P X |

FOREIGN PATENT DOCUMENTS

| | | | |
|---|---|---|---|
| 502432 | 4/1951 | Belgium | 222/420 |

*Primary Examiner*—Allen N. Knowles
*Assistant Examiner*—Frederick R. Handren
*Attorney, Agent, or Firm*—Cahill, Sutton & Thomas

[57] ABSTRACT

A capillary tube applicator for dispensing anaerobic and cyanoacrylate adhesives is penetratingly inserted and retained in place by an interference fit within a cap attached internal to the neck of a container for the adhesive.

4 Claims, 2 Drawing Figures

DISPENSER FOR ANAEROBIC AND CYANOACRYLATE ADHESIVES

The present invention relates to dispensers for adhesives and, more particularly, to applicators for anaerobic and cyanoacrylate adhesives.

Anaerobic and cyanoacrylate adhesives are agents which chemically bond materials to one another. The cure time is generally from five to twenty seconds, depending upon the formulation of the adhesive and the proximity to one another of the surfaces to be joined.

These adhesives have wide spread use in many different industries. In example, the medical profession can use the adhesives to bond living tissue to itself or to inert objects. For the more prosaic arts, essentially all naturally occurring or man-made inert substances may be bonded to one another.

To achieve a bond, the two surfaces to be joined are placed adjacent one another and preferably under at least slight pressure to minimize the spacing therebetween to the greatest extent. The adhesive is sparingly allowed to flow into the junction. Thereafter, the adhesive will seep into or penetrate the interstices intermediate the two surfaces. Moreover, penetration into the materials to be joined will also occur, which penetration is a function of the porosity of the material. The resulting bond is of a molecular type and, in most instances, is stronger than the materials themselves.

The permeating capability of these types of adhesives is such that a drop of one-hundredth of a cubic centimeter (0.01 cc.) will spread over an area of approximately one-half inch square intermediate two blocks of pine wood and penetrate an eighth of an inch or more into each of the blocks of wood. Because of this permeating capability, applicators for dispensing these adhesives must be specially configured to prevent leakage from the applicator. Moreover, because of the large surface area which can be bonded with relatively minute amounts of the adhesive, the applicators must be capable of accurately dispensing minute quantities onto precise locations.

It is therefore a primary object of the present invention to provide an applicator for anaerobic and cyanoacrylate adhesives.

Another object of the present invention is to provide an applicator for anaerobic and cyanoacrylate adhesives which is capable of accurately dispensing a minute quantity.

Yet another object of the present invention is to provide an applicator for anaerobic and cyanacrylate adhesives wherefrom leakage will not occur.

Still another object of the present invention is to provide a non-clogging applicator for anaerobic and cyanoacrylate adhesives.

These and other objects of the present invention will become apparent to those skilled in the art as the description thereof proceeds.

The present invention will be described with greater specificity and clarity with reference to the following drawings, in which.

Figure 1:
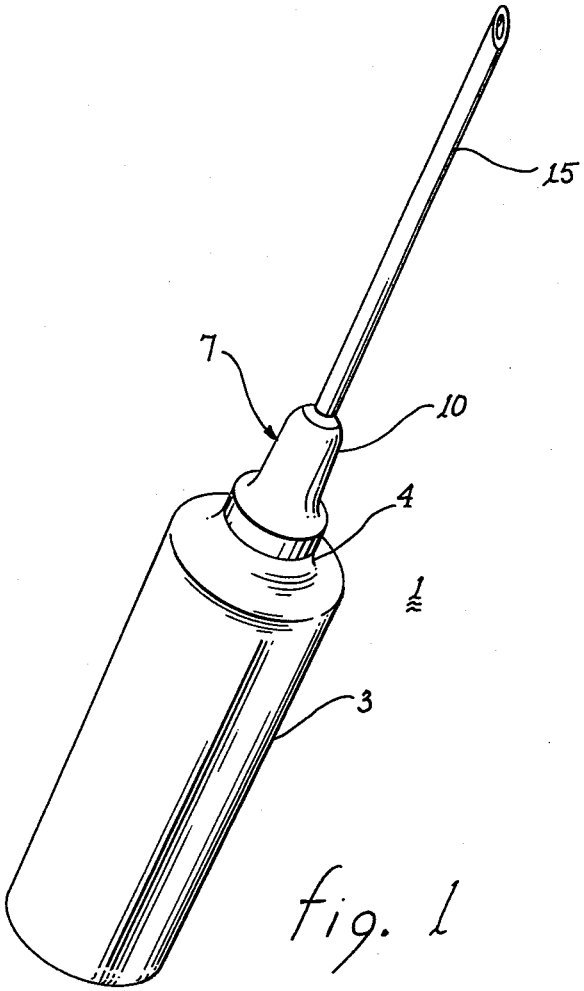
FIG. 1 illustrates an applicator attached to a container housing anaerobic and/or cyanoacrylate adhesives.

The adhesive dispenser 1 illustrated in FIG. 1 includes a container 3, which may be of the cylindrical type having a necked section 4. An applicator 7 is attached within and extends from necked section 4. The applicator is formed by a base 10 having a flexible capillary tube 15 extending therefrom.

Figure 2:
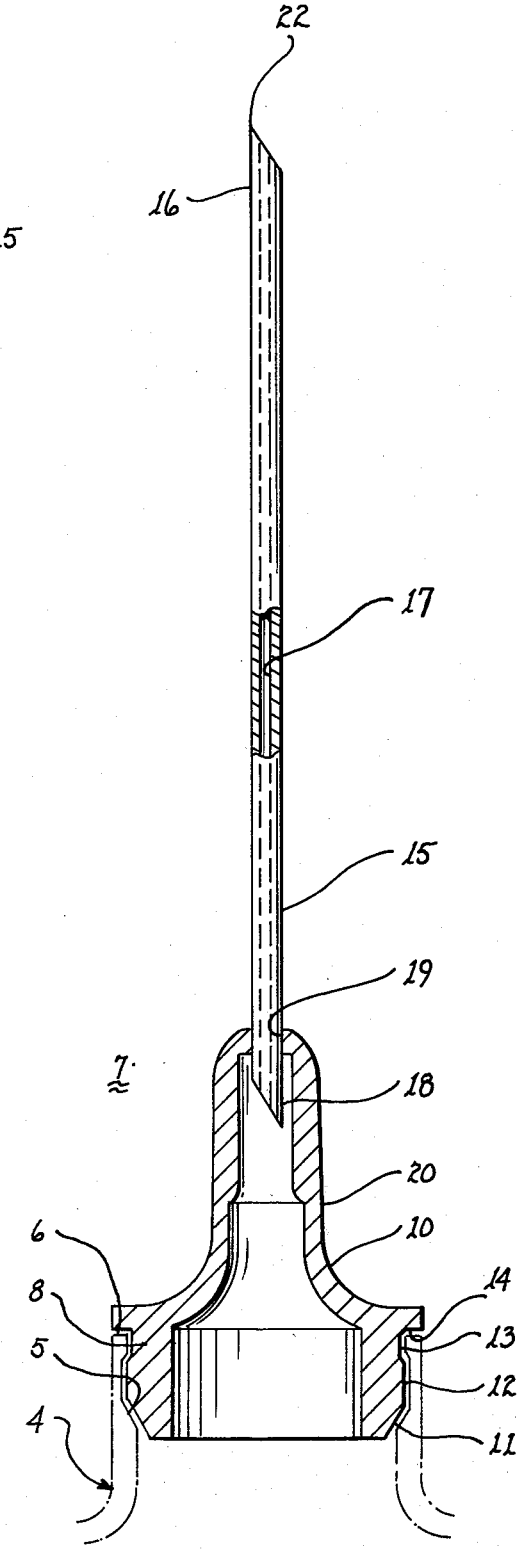
FIG. 2 is a partial cross-sectional view of the applicator.

The details of the applicator will be described with primary reference to FIG. 2. The lower part 8 of base 10 fits within and tightly engages the internal surface 5 (illustrated in phantom lines) of necked portion 4 of container 3. It includes a circumferential beveled edge 11 terminated by the lower edge of a radially expanded annular band 12. An annular depression 13 is disposed intermediate the upper edge of band 12 and a radially extending shoulder 14. The internal surface of necked portion 4 of container 3 is configured to mate with beveled edge 11, annular band 12 and annular depression 13 such that shoulder 14 rests upon at least part of upper edge 6 of the necked section. Thereby, applicator 7 is retained within necked portion 4 by an interference fit.

Base 10 is hollow to permit the flow of the adhesive from within container 3 into nipple section 20 of the base. In the preferred embodiment, the diameter of aperture 19 within nipple 20 is sixty-two thousandths of an inch (0.062") with a tolerance of plus three thousandths of an inch (+0.003") and minus two thousandths of an inch (−0.002").

Capillary tube 15 is formed of non-rigid plastic material, such as the products sold under the trademark Teflon and of grade TFE. Preferably, its outside diameter is sixty-five thousandths of an inch (0.065") with a tolerance of plus two thousandths of an inch (+0.002") and minus one thousandths of an inch (−0.001") and the diameter of passageway 17 is twenty-one thousandths of an inch (0.021") with a tolerance of plus or minus two thousandths of an inch (± 0.002"). The volume of the drops discharged from the capillary tube are nominally on the order of one hundredth of a cubic centimeter (0.01 cc.).

By inspection, it becomes apparent that aperture 19 is of a lesser diameter than capillary tube 15. Hence, the capillary tube must be forced into the aperture. The resulting force fit tends to insure essentially complete surface contact intermediate the surface of the aperture and the encircled section of the capillary tube.

By cutting the ends 16 and 18 of the capillary tube at a bias of 60° plus or minus 5°, several benefits are achieved. First, insertion of end 18 within nipple 20 is relatively easy resulting from the required gradual expansion of aperture 19 with an accompanying gradual contraction of the end. At end 16, the resulting point 22 permits accurate dispensing of the adhesive along the junction between two elements to be bonded to one another, thereby minimizing waste. For intricate and highly detailed work where pinpoint application of the adhesive is mandatory, no other method of application is satisfactory. It has also been found by experimentation that by cutting end 16 of capillary tube 15 at a bias of approximately 60°, clogging almost never occurs whereas where the end is cut normal to the axis of the capillary tube, crusting and ultimate clogging of passageway 17 occurred very frequently. A full and comprehensive technical explanation of these differing results depending upon the bias at which end 16 is cut is not presently available to applicant.

In operation, the tight interference fit intermediate necked portion 4 and face 10 tends to constrain leakage or seepage or anaerobic and cyanoacrylate adhesives therethrough. However, initially some leakage may in fact occur. As the spacing intermediate the inner surface 5 and lower part 8 of the base is very minute, bonding of these two elements to one another will be promoted and which bonding, when it occurs, establishes an essentially seep proof seal. Similarly, the interference fit intermediate capillary tube 15 and aperture 19 of nipple 20 leaves, at most, very minute interstices therebetween wherethrough seepage might occur. Again, because of the minute spacing between the tube and the aperture, the tube will usually become bonded to the nipple and preclude further seepage. In some cases, bonding has not occurred intermediate either the necked portion and the base or the capillary tube and aperture 19; even though bonding might not always occur, the crusting resulting after an initial seepage developes an effective seal.

At such time as end 16 may become crusted and clogged or in the event the capillary tube is squeezed shut and resulting in crusting or clogging, the tube need only be flexed to dislodge the clots. The clots are then discharged from the capillary tube by applying pressure to container 3.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. An applicator for dispensing anaerobic and cyanoacrylate adhesives in minute and precise quantities from a container to a point of application, said applicator comprising in combination:

(a) a neck defining the opening to said container, said neck including: a circular inner surface comprising a radially expanded annular depression and a radially inwardly extending annular shoulder disposed at each side of said annular depression;

(b) a hollow base for sealingly engaging said neck, said base including:

i. a nipple section having a passageway circular in cross-section extending through the upper extremity thereof; and ii. a hollow lower part of plastic material having a skirt for mating with said circular surface of said neck, said skirt of said lower part including a radially expanded annular band disposed intermediate a radially inwardly sloping annular beveled surface and a radially inwardly extending annular depression for lockingly mating with corresponding mirror image elements developed within said circular inner surface of said neck;

(c) a flexible capillary tube of Teflon plastic material of grade TFE penetratingly mounted within said passageway for conveying the adhesive from within said hollow lower part to the point of application, said capillary tube being of a diameter greater than the diameter of said passageway whereby said capillary tube must be force fit into said passageway, said capillary tube including an adhesive receiving end cut at a bias in the range of 55 degrees to 65 degrees to aid in penetration of said passageway upon insertion therein and an adhesive dispensing end cut at a bias in the range of 55 degrees to 65 degrees to aid in unclogging said dispensing end by flexing said dispensing end to remove crusted adhesive therefrom.

2. The applicator as set foth in claim 1 wherein the diameter of said capillary tube is 0.065" with a tolerance of plus 0.002" and minus 0.001" and the diameter of said passageway is 0.062" with a tolerance of plus 0.003" and minus 0.002".

3. The applicator as set forth in claim 2 wherein the diameter of the passageway within said capillary tube is 0.021" with a tolerance of ± 0.002".

4. The applicator as set forth in claim 3 wherein said first and second ends are cut at a bias of 60°.

* * * * *